US009169681B2

(12) United States Patent
Cooper et al.

(10) Patent No.: US 9,169,681 B2
(45) Date of Patent: Oct. 27, 2015

(54) LOW PROFILE ADJUSTABLE SOFT CLOSE HINGE APPARATUS

(71) Applicant: Hardware Resources, Inc., Bossier City, LA (US)

(72) Inventors: Rachel Cooper, Farmers Branch, TX (US); Dennis McGregor, Farmers Branch, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 14/263,788

(22) Filed: Apr. 28, 2014

(65) Prior Publication Data

US 2015/0218863 A1 Aug. 6, 2015

Related U.S. Application Data

(60) Provisional application No. 61/934,436, filed on Jan. 31, 2014.

(51) Int. Cl.

| | |
|---|---|
| ***E05D 3/14*** | (2006.01) |
| ***E05D 7/04*** | (2006.01) |
| ***E05D 7/12*** | (2006.01) |
| ***E05D 7/00*** | (2006.01) |
| ***E05D 3/18*** | (2006.01) |
| ***E05F 5/00*** | (2006.01) |

(52) U.S. Cl.

CPC ..... *E05D 7/0009* (2013.01); *E05D 3/14* (2013.01); *E05D 3/142* (2013.01); *E05D 3/18* (2013.01); *E05D 3/183* (2013.01); *E05D 7/0407* (2013.01); *E05D 7/123* (2013.01); *E05D 7/125* (2013.01); *E05F 5/006* (2013.01); *Y10T 16/304* (2015.01); *Y10T 16/5386* (2015.01); *Y10T 16/5476* (2015.01)

(58) Field of Classification Search

CPC ..... E05F 5/006; E05D 7/0407; E05D 7/123; E05D 7/125; E05D 3/14; E05D 3/142; E05D 3/18; E05D 3/183; E05D 11/1021; E05D 7/0009; E05D 7/0054; Y10T 16/5386; Y10T 16/5474; Y10T 16/5475; Y10T 16/5476; Y10T 16/2771; Y10T 16/283; Y10T 16/304; Y10T 16/54021; Y10T 16/540243

See application file for complete search history.

(56) References Cited

U.S. PATENT DOCUMENTS

| | | | | |
|---|---|---|---|---|
| 3,256,554 | A | 6/1966 | Turner | |
| 4,251,900 | A | 2/1981 | Lautenschläger | |
| 4,502,182 | A | 3/1985 | Lautenschläger et al. | |
| 4,590,641 | A | 5/1986 | Lautenschläger et al. | |
| 4,716,622 | A | 1/1988 | DeBruyn | |
| 5,029,362 | A | 7/1991 | Prodan | |
| 5,343,595 | A * | 9/1994 | Lautenschlager | 16/257 |
| 6,032,333 | A * | 3/2000 | Brustle | 16/242 |

(Continued)

*Primary Examiner* — Jeffrey O Brien

(74) *Attorney, Agent, or Firm* — Schultz & Associates, P.C.

(57) ABSTRACT

Disclosed is a low profile, adjustable, soft close hinge comprised of a hinge cup pivotally connected to a hinge body via a hinge arm and a hinge link in a four-bar linkage arrangement. A spring biases the hinge to a closed position. The hinge body is adjustably connected to an inner frame with an overlay adjustment screw and depth adjustment cam. The inner frame releasably connects the hinge body to a mounting plate. A stop bracket is adjustably and slidably connected to the hinge body by a helical cam. The adjustable position of the stop bracket relative to the hinge body determines the point at which the damping functionality of a damper begins during a hinge closing movement. A linkage sub-assembly pivotally connects the damper to the hinge link.

17 Claims, 8 Drawing Sheets

(56) References Cited

U.S. PATENT DOCUMENTS

| | | | | |
|---|---|---|---|---|
| 6,591,454 | B2 | 7/2003 | Brustle | |
| 6,684,453 | B2 | 2/2004 | Wang | |
| 6,715,180 | B2 * | 4/2004 | Mueller et al. | 16/236 |
| 6,859,979 | B2 | 3/2005 | Egger et al. | |
| 7,065,833 | B2 | 6/2006 | Kropf | |
| 7,127,778 | B2 | 10/2006 | Salice | |
| 7,275,284 | B2 | 10/2007 | Lautenschläger et al. | |
| 7,328,484 | B2 | 2/2008 | Salice | |
| 7,395,580 | B2 | 7/2008 | Brüstle | |
| 7,406,749 | B2 | 8/2008 | Herper | |
| 7,533,445 | B2 | 5/2009 | Salice | |
| 7,562,416 | B2 | 7/2009 | Lautenschläger et al. | |
| 7,600,295 | B2 | 10/2009 | Zimmer | |
| 7,653,967 | B2 | 2/2010 | Lowe et al. | |
| 7,712,185 | B2 | 5/2010 | Pyo | |
| 7,730,583 | B2 | 6/2010 | Salice | |
| 7,874,043 | B2 | 1/2011 | Salice | |
| 7,917,995 | B2 | 4/2011 | Salice | |
| 8,205,298 | B2 * | 6/2012 | Lin et al. | 16/287 |
| 8,214,973 | B2 | 7/2012 | Salice | |
| 8,225,459 | B2 | 7/2012 | Waltemate et al. | |
| 8,424,161 | B2 | 4/2013 | Sutterlütti | |
| 8,505,165 | B2 | 8/2013 | Domenig et al. | |
| 8,601,644 | B1 * | 12/2013 | Chen et al. | 16/286 |
| 2002/0078527 | A1 * | 6/2002 | Mueller et al. | 16/254 |
| 2003/0041412 | A1 * | 3/2003 | Mueller et al. | 16/236 |
| 2003/0061682 | A1 * | 4/2003 | Muelller et al. | 16/238 |
| 2007/0289094 | A1 | 12/2007 | Lowe et al. | |
| 2008/0109987 | A1 * | 5/2008 | Chen et al. | 16/68 |
| 2010/0025173 | A1 | 2/2010 | Herper et al. | |
| 2010/0281652 | A1 * | 11/2010 | Oshima | 16/236 |
| 2011/0072617 | A1 * | 3/2011 | Lin et al. | 16/298 |
| 2011/0083299 | A1 | 4/2011 | Krüdener | |
| 2011/0154609 | A1 | 6/2011 | Liao | |
| 2013/0055528 | A1 | 3/2013 | Lowe | |
| 2013/0239363 | A1 * | 9/2013 | Apur | 16/50 |
| 2014/0115826 | A1 * | 5/2014 | Nuckolls et al. | 16/235 |

* cited by examiner

LOW PROFILE ADJUSTABLE SOFT CLOSE HINGE APPARATUS

CROSS-REFERENCE TO RELATED APPLICATIONS

This application claims the benefit of U.S. Provisional Patent Application No. 61/934,436 filed on Jan. 31, 2014, the contents of which are incorporated herein by reference.

FIELD

The present disclosure relates to soft close hinges for furniture products. In particular, the present disclosure relates to a hinge providing adjustable, soft close functionality having a low profile to minimize encroachment of usable cabinet space.

BACKGROUND

In the field of cabinetry and mill work, a recurring problem is the uncontrolled speed at which a cabinet door closes. Uncontrolled closure can result in slamming of cabinetry doors creating unwanted noise and premature wear of cabinet hinges and cabinet faces. A damping device, such as a soft close hinge, manipulates the closing motion of the cabinet door at a controlled rate so that the cabinet door, regardless of how much force is used to begin the closing motion, will softly and quietly close without slamming into the cabinet frame. A cabinet door that closes softly and quietly extends the life of both the millwork and the hinge hardware thus reducing the need for repair or replacement.

Prior art soft close hinges can be large and cumbersome. Functionality is provided by a spring damper mechanism attached between the hinge arm and the hinge body. The spring damper mechanism adds size to the hinge and thus the hinge tends to be bulky and complicated.

The prior art is replete with soft close hinge designs. However, most suffer from various disadvantages including size, complexity, durability, difficulty of installation, and high manufacturing cost.

U.S. Pat. No. 6,684,453 to Wang discloses a hinge assembly capable of damping door movement. The assembly includes a damping unit mounted on a seat that is connected to a door frame. A housing is embedded in a door panel. A hinge arm and a positioning member pivotally connect the securing seat and the housing. The damping unit includes a fluid filled cylinder and a piston rod having an actuating end pivotally connected to the positioning member.

U.S. Pat. No. 8,205,298 to Lin, et al. discloses a dampening hinge. The hinge includes a base adjustably connected to a coupling assembly. The base is pivotally connected to a hinge cup and biased by a spring. A buffer assembly includes a cylindrical damper and a set of links which are connected to the damper at one end and pivotally connected to the hinge cup at the other. The links include an arcuate slot designed to reduce the pivotal angle of the damper and to reduce the overall volume of the hinge. The damping functionality is not adjustable.

U.S. Patent Publication No. 2011/0083299 to Krudener discloses a furniture hinge. The hinge is comprised of a housing pivotally connected to a hinge cup with a series of links and a connecting rod. A spring biases the pivotal connection. Spring arms rest on the connecting rod. The cylindrical body of a fluid filled damper is pivotally connected to the series of links. The piston rod extending from the damper is supported in a receptacle which is connected to an adjustment screw acting on the housing. In this manner, the angle of the damper relative to the housing can be adjusted. The housing is oversized to accommodate the adjustment of the damper.

U.S. Patent Publication No. 2011/0154609 to Liao discloses a dampening hinge. The hinge is comprised of a hinge cup pivotally connected to a housing by a hinge arm and biased by a torsion spring. An inner housing is adjustably connected to the housing and pivotally connected to a cylindrical body of a fluid filled damper. A series of links pivotally connects the hinge cup to the inner housing and the piston rod. The position of the damper relative to the housing is not adjustable.

Therefore, a need exists for an easily installed, low-profile, simple and affordable soft close hinge providing an adjustable damping functionality while still delivering precision and soft close motion to the cabinet door.

SUMMARY

A preferred embodiment is comprised of a hinge cup mounted in a cabinet door and pivotally connected to a hinge body by a four-bar linkage arrangement biased by a spring. The four-bar linkage includes a hinge arm and a set of hinge links. The spring includes a spring brace which rides on the set of hinge links to alter the bias of the spring as the apparatus moves between open and closed positions. The hinge body is adjustably attached to an inner frame which is mounted to a hinge plate mounted to a cabinet carcass. An overlay adjustment screw and a depth adjustment cam are provided to adjust the position of the body relative to the inner frame. A damper is pivotally connected to the set of hinge links and is slidable within a stop bracket. The stop bracket is housed within the inner frame and includes a protrusion. A soft close adjustment helical cam includes a groove which interacts with the protrusion to adjustably control the longitudinal position of the stop bracket. A lock ring is fitted on the soft close adjustment helical cam to attach it to the hinge body. An anti-rotation plate attaches the stop bracket to the helical cam.

In use, the apparatus controls the closing speed of the cabinet door. The position of the damper is adjustable to control the point at which the damping functionality begins during a closing movement of the hinge. As the soft close helical cam is rotated, the protrusion on the top of the stop bracket follows the groove in the helical cam allowing the stop bracket to move longitudinally in the inner frame. The damper slidingly engages an open-ended slot within the stop bracket. The closed end of the slot provides a contact point for the damper. Altering the longitudinal position of the stop bracket and thus the slot, alters the contact point and adjusts when the damper begins its damping function. The spring brace moving on the contours of the hinge link exaggerate the closing force. The spring force opposes the damping force of the damper to close the door quietly and softly.

Those skilled in the art will appreciate the above-mentioned features and advantages of the disclosure together with other important aspects upon reading the detailed description that follows in conjunction with the drawings.

DETAILED DESCRIPTION OF THE PREFERRED EMBODIMENT

In the description that follows, like parts are marked throughout the specification and figures with the same numerals, respectively. The figures are not necessarily drawn to scale and may be shown in exaggerated or generalized form in the interest of clarity and conciseness.

Figure 1:
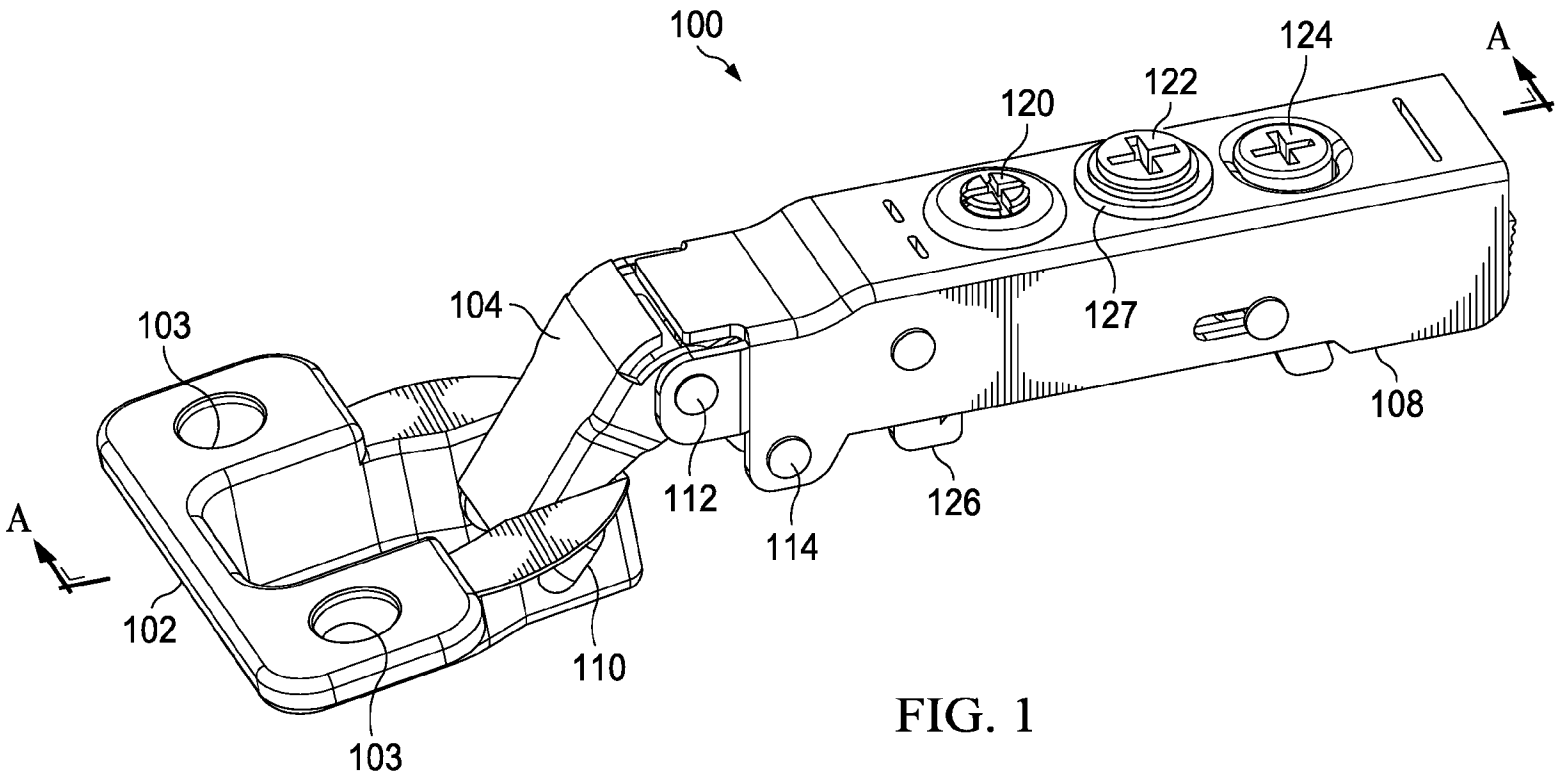
FIG. 1 an isometric view of a preferred embodiment.
Figure 2:
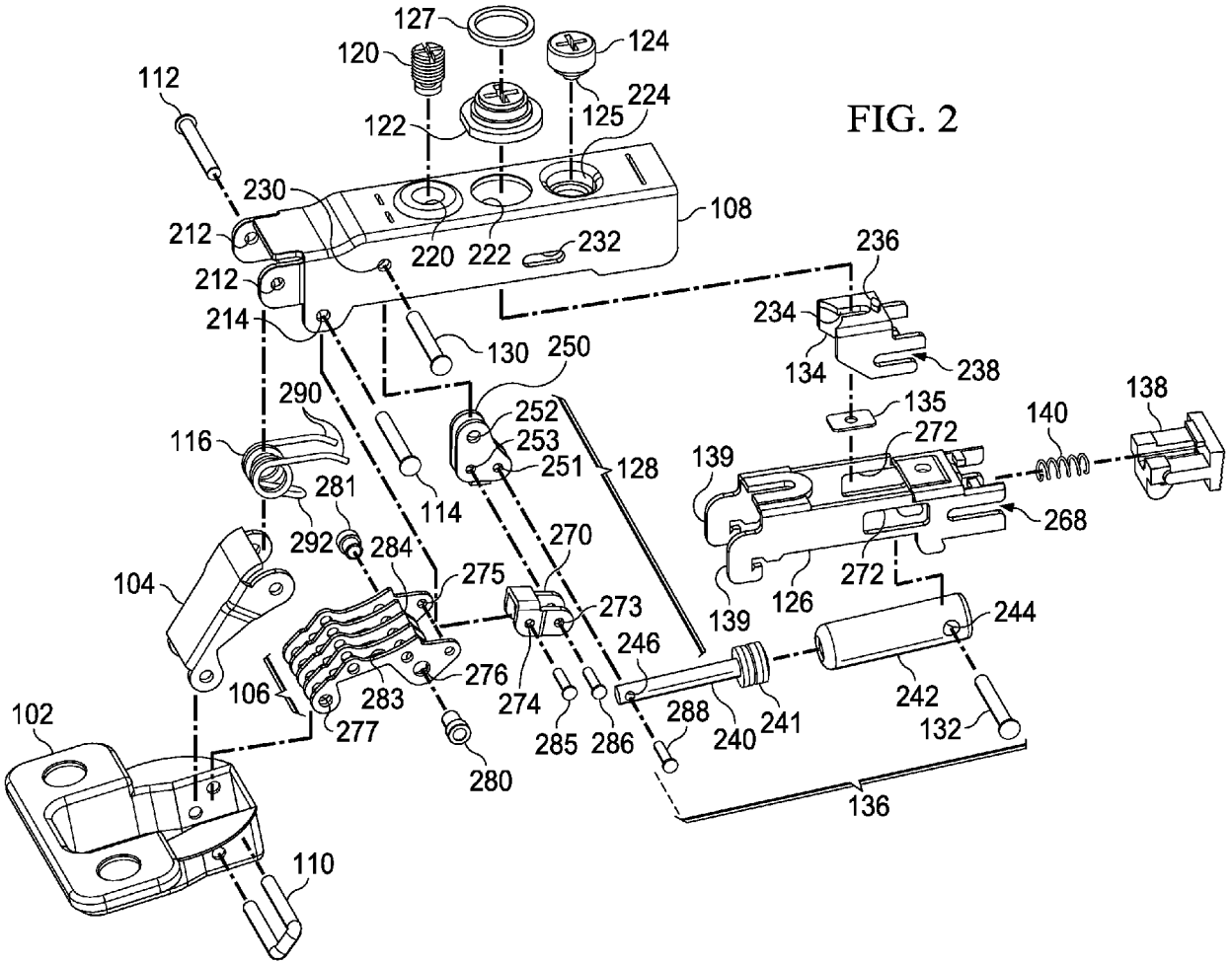
FIG. 2 is an exploded isometric view of a preferred embodiment.

Referring to FIGS. 1 and 2, hinge 100 includes hinge cup 102 pivotally connected to hinge arm 104 and hinge link 106 by U-shaped hinge cup pin 110. Those skilled in the art recognize that hinge cup pin 110 can be replaced by separate keeper pins. Hinge arm 104 and hinge link 106 are pivotally connected to hinge body 108 at pin 112 and pin 114, respectively. Thus, a four-bar linkage is formed. Pivotally connected to hinge link 106 is linkage sub-assembly 128. Typically, hinge cup 102 is affixed to a cabinet door with screws through holes 103. In a preferred embodiment, the components of hinge 100 are typically constructed of metal such as cast aluminum or steel alloy plate stock and formed by stamping.

Seated in hinge body 108 are overlay adjustment screw 120, helical cam 122, and depth adjustment cam 124. Passing laterally through hinge body 108 are linkage pivot pin 130 and damper pin 132. Housed within hinge body 108 is inner frame 126. The position of inner frame 126 is adjustable relative to hinge body 108 via overlay adjustment screw 120 and depth adjustment cam 124. Stop bracket 134 is slidable within inner frame 126. Stop bracket 134 is adjustable relative to hinge body 108. Stop bracket 134 is affixed adjacent helical cam 122 by plate 135. Damper 136 is housed within and slidably engaged with stop bracket 134. Damper 136 is pivotally connected to linkage sub-assembly 128. Release assembly 138 in conjunction with hooks 139 releasably attach hinge 100 to a mounting plate where the mounting plate is securely affixed to a cabinet carcass. Typically, the mounting plate is affixed with mounting screws and the location of the mounting plate can be adjusted in a vertical plane without removing the mounting screws completely. Release assembly 138 is slidably engaged with inner frame 126. Coil spring 140 biases release assembly 138 away from and out of inner frame 126. A force applied to release assembly 138 towards inner frame 126 compresses coil spring 140 and allows for quick connection and quick release of hinge 100 to the mounting plate.

Figure 3:
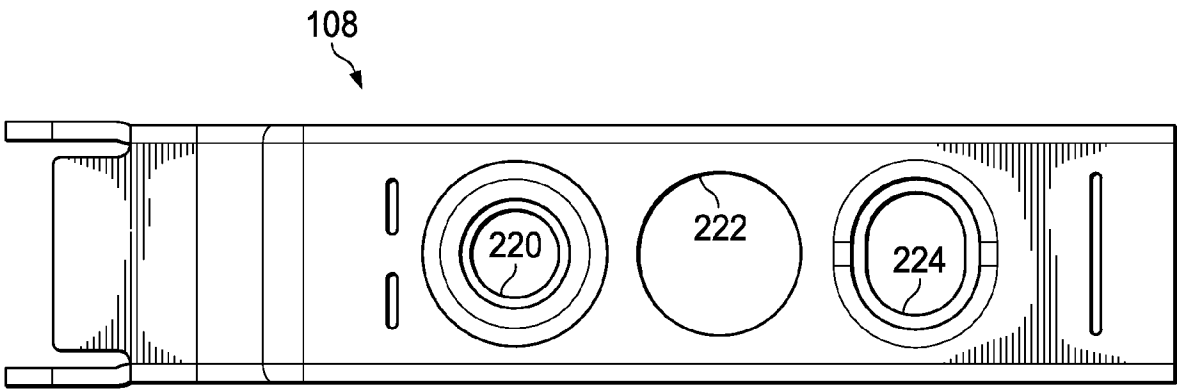
FIG. 3 is a top view of the hinge body of a preferred embodiment.

Referring to FIGS. 2 and 3, hinge body 108 includes a generally U-shaped cross section. Each lateral side of hinge body 108 includes pivot holes 212 and 214. Pivot holes 212 and 214 on each side of hinge body 108 are axially aligned and are sized to accommodate pins 112 and 114, respectively. The longitudinal axes of pins 112 and 114 are generally parallel to the pivot axes of hinge cup pin 110. Each lateral side of hinge body 108 further includes pivot hole 230 and damper pin slot 232. Pivot holes 230 and damper pin slots 232 on each side of hinge body 108 are axially aligned and are sized to accommodate linkage pivot pin 130 and damper pin 132, respectively.

The upper surface of hinge body 108 includes threaded hole 220, helical cam hole 222, and cam slot 224. Threaded hole 220 receives a threaded section of overlay adjustment screw 120. Helical cam hole 222 receives helical cam 122 and cam slot 224 receives depth adjustment cam 124.

Figure 4:
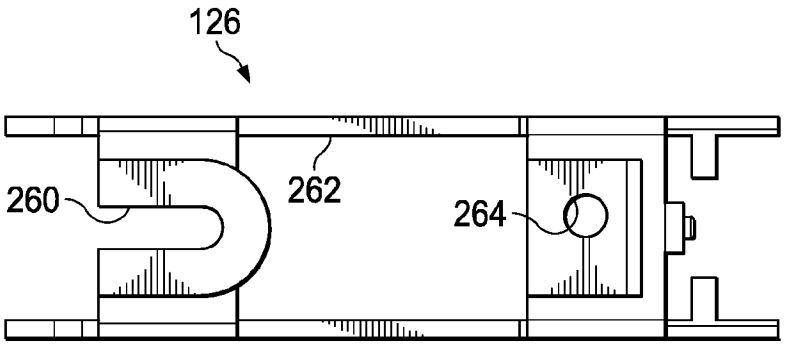
FIG. 4 is a top view of the inner frame of a preferred embodiment

Referring to FIGS. 2 and 4, inner frame 126 has a generally U-shaped cross section. The width of inner frame 126 is sized to fit between the lateral sides of hinge body 108. The upper surface of inner frame 126 includes overlay slot 260, stop bracket slot 262, and depth adjustment hole 264. An unthreaded section of overlay adjustment screw 120 extends through overlay slot 260. The unthreaded section expands to slidably connect hinge body 108 to inner frame 126 within overlay slot 260. Overlay adjustment screw 120 is free to rotate with respect to hinge body 108 and inner frame 126. Depth adjustment cam 124 includes offset extension 125. Offset extension 125 extends through depth adjustment hole 264. The end of offset extension 125 is flattened to attach hinge body 108 to inner frame 126 and to prevent depth adjustment cam 124 from backing out. Depth adjustment cam 124 is free to rotate with respect to both hinge body 108 and inner frame 126. Inner frame 126 further includes openings 272. Openings 272 on each side of inner frame 126 are axially aligned. Damper pin 132 passes through openings 272 in inner frame 126 and damper pin slots 232 in hinge body 108. The ends of damper pin 132 are flattened to prevent removal from hinge body 108. Slot 268 on each side of inner frame 126 is sized to slidably receive release assembly 138.

Figure 5B:
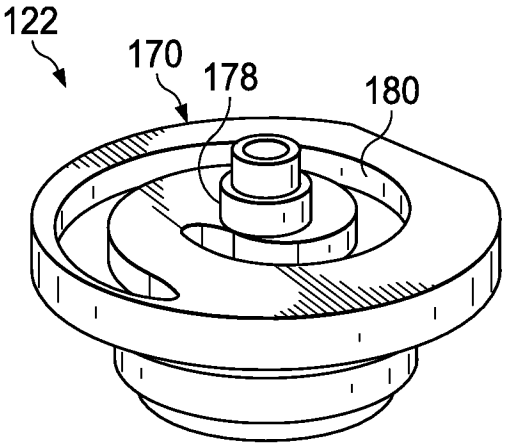
FIG. 5B is an isometric view of the helical cam of a preferred embodiment.
Figure 5A:
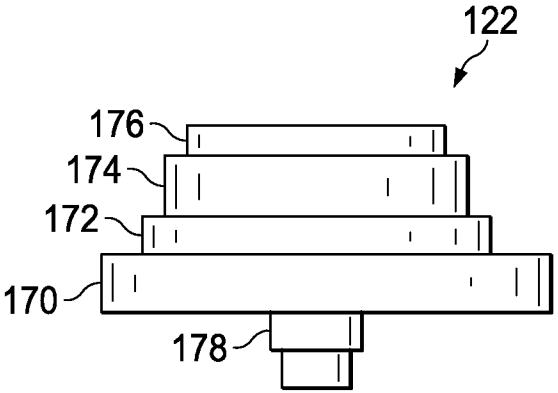
FIG. 5A is a plan view of the helical cam of a preferred embodiment.

Referring to FIGS. 2 and 5A-5B, helical cam 122 is generally cylindrical shaped. Helical cam 122 is comprised of lip section 170, base section 172, neck section 174, and head section 176. Extending from lip section 170 is post 178. Included in lip section and spiraling around post 178 is groove 180. Head section 176 includes a receptacle suitably shaped to receive a torque producing tool head. Lip section 170 abuts the underside of the upper surface of hinge body 108. Base section 172 is nested within helical cam hole 222. Neck section 174 and head section 176 extend from helical cam hole 222. Lock ring 127 surrounds helical cam 122 at neck section 174 and secures helical cam 122 to the hinge body.

Figure 6:
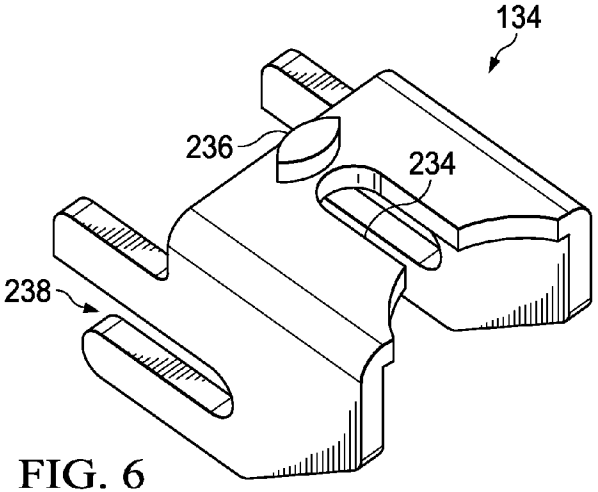
FIG. 6 is an isometric view of the stop bracket of a preferred embodiment.

Referring to FIGS. 2 and 6, stop bracket 134 has a generally U-shaped cross-section. The upper surface of stop bracket 134 includes slot 234 and protrusion 236. Protrusion 236 is sized to engage groove 180. Both lateral sides of stop bracket 134 include open-ended slot 238. Slot 238 is sized to accommodate damper pin 132. Post 178 extends through slot 234 and through a hole in plate 135. The end of post 178 is flattened to rotatably attach helical cam 122 to stop bracket 134. Helical cam 122 is free to rotate with respect to hinge body 108 and stop bracket 134. Post 178 slides through the length of slot 234. The rectangular shape of plate 135 prevents plate 135 from rotating within stop bracket 134.

Damper 136 is comprised of piston rod 240 extending from cylinder 242. Piston rod 240 includes piston head 241 on one end contained within cylinder 242 and link hole 246 on the opposite end for pivotal connection to linkage sub-assembly 128. Cylinder 242 includes hole 244 for pivotal connection to hinge body 108. Hole 244 is sized to accommodate damper pin 132. Cylinder 242 is permitted to slide longitudinally within stop bracket 134 through the length of slot 238. Damper 136 is a single direction damper. Damper 136 provides a damping functionality as piston rod 240 moves in an outwardly direction from cylinder 242.

Linkage sub-assembly 128 is comprised of pivot link 250 and connecting link 270. Pivot link 250 is comprised of a pair of generally triangular shaped plates bridged together by a brace. Pivot link 250 includes piston rod hole 251, pivot hole 252 and connecting link hole 253. Connecting link 270 is comprised of a pair of identically shaped opposing links bridged by a brace. Connecting link 270 includes pivot link hole 273 and hinge link hole 274. Connecting ling 270 is pivotally connected to pivot link 250 with pin 286 through pivot link hole 273 and connecting link hole 253. Pivot link 250 is pivotally connected to damper 136 with pin 288 through piston rod hole 251 and link hole 246.

Hinge link 106 is comprised a plurality of interlocking plates. In a preferred embodiment, each plate is formed by a single stamping operation. Hinge link 106 includes connecting link hole 275, pivot hole 276, and pivot hole 277. Hinge link 106 further includes arcuate surface 283 leading to peak 284. Shock absorbing spacers 280 and 281 are adjacent opposite sides of hinge link 106 and are axially aligned with pivot holes 276. In preferred embodiments, the spacers are formed of a semi-rigid plastic polymer material such as Teflon® or Delrin®. The materials are also resilient and so can be repeatedly compressed both axially and radially and will return to their original dimensions. In a preferred embodiment, spacers 280 and 281 are cylindrical, have a circular cross section, and may freely rotate. Each spacer includes a hole for receiving pin 114.

Hinge link 106 is pivotally connected to connecting link 270 with pin 285 through hinge link hole 274 and connecting link hole 275. Hinge link 106 is pivotally connected to hinge body 108 with pin 114 through pivot hole 276 and pivot hole 214. Hinge link 106 is pivotally connected to hinge cup 102 with hinge cup pin 110 through pivot hole 277.

Spring 116 is coiled around pin 112 and biases hinge 100 to a closed position. Spring 116 comprises a pair of spring arms 290 and spring brace 292. Spring arms 290 extend from the coil and rest adjacent hinge body 108. Spring brace 292 extends from the coil and rests adjacent peak 284. As hinge 100 opens and closes, spring brace 292 maintains contact with peak 284, varying the bias provided by spring 116.

Figure 8A:
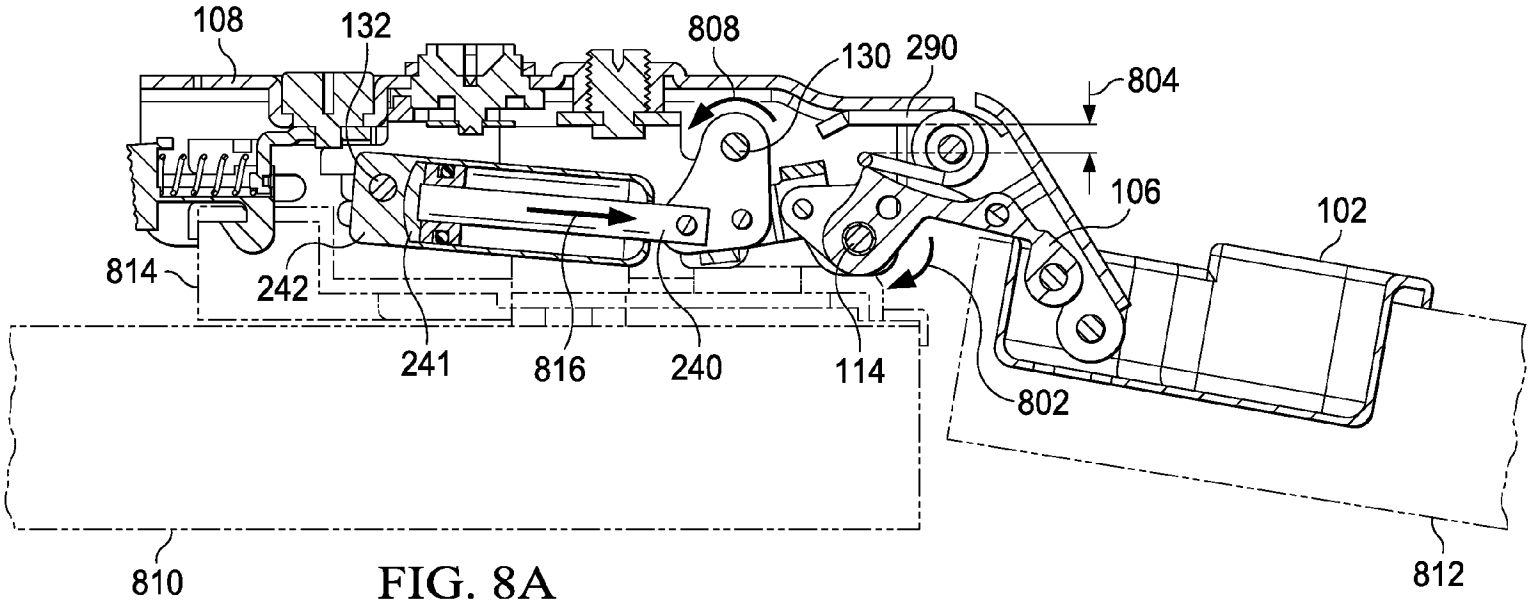
FIG. 8A is a sectional view of a preferred embodiment in the open position taken along line A-A of FIG. 1.
Figure 8B:
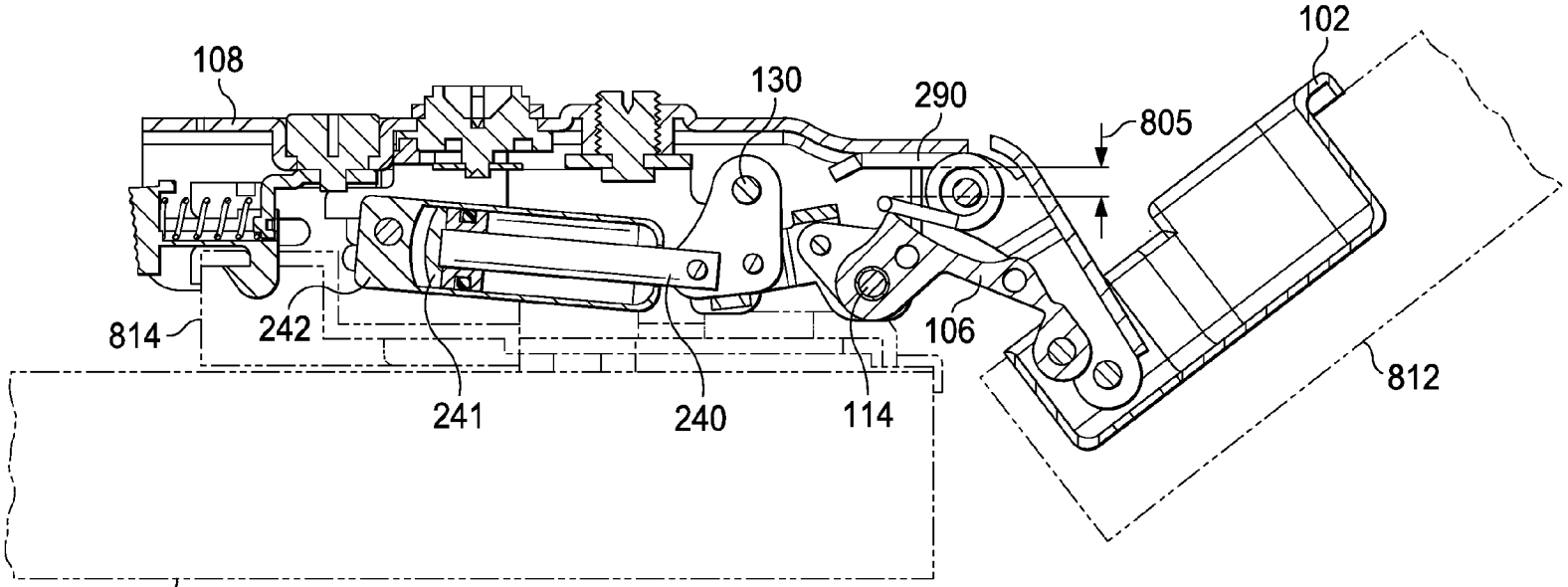
FIG. 8B is a sectional view of a preferred embodiment between the open and closed positions taken along line A-A of FIG. 1.
Figure 8C:
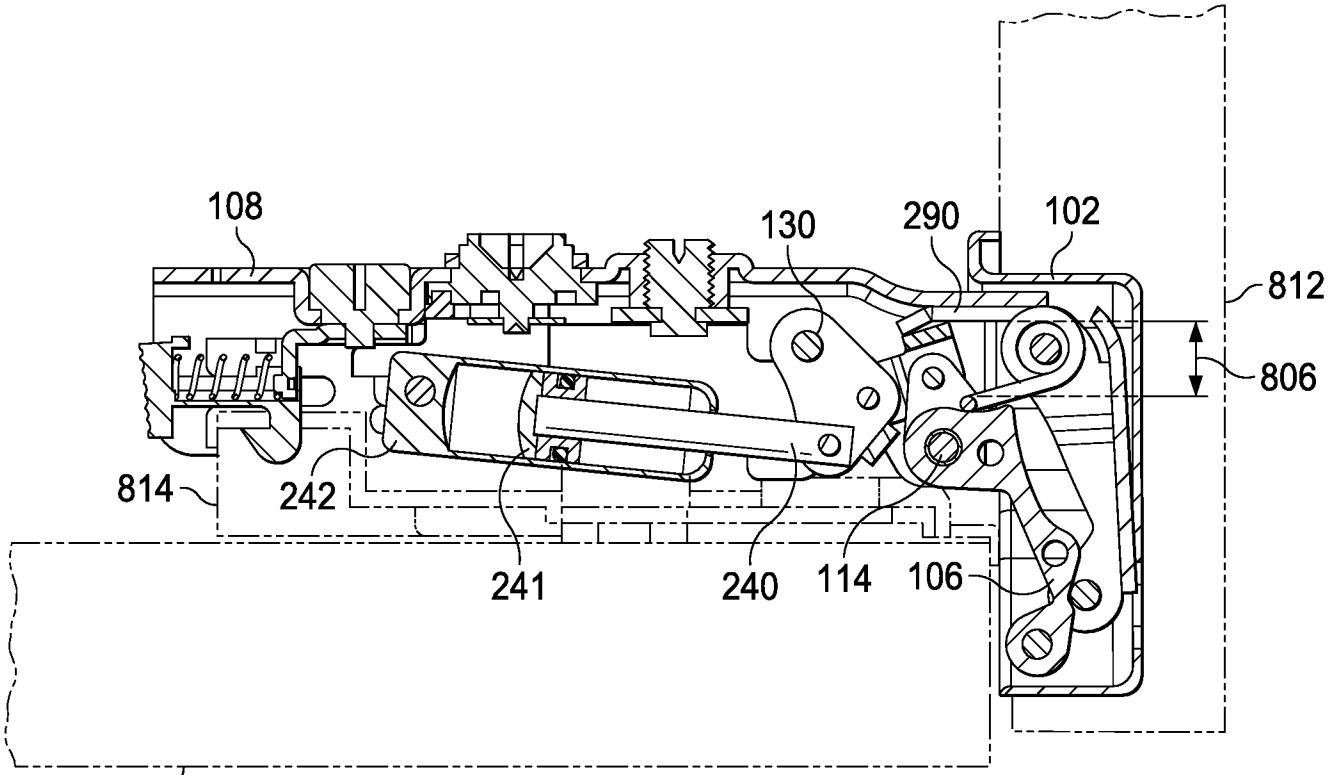
FIG. 8C is a sectional view of a preferred embodiment in the closed position taken along line A-A of FIG. 1.

Referring to FIGS. 8A-8C, in use, hinge 100 controls the closing speed of cabinet door 812 pivotally attached to cabinet carcass 810. Hinge 100 is releasably attached to mounting plate 814, where the mounting plate is affixed to cabinet carcass 810 and hinge cup 102 is affixed in a bore in cabinet door 812. As cabinet door 812 moves from the open position to the closed position, hinge link 106 rotates about pin 114 in direction 802 (clockwise as oriented in FIGS. 8A-8C). As hinge link 106 rotates, the connections of linkage sub-assembly 128 cause pivot link 250 to rotate about linkage pivot pin 130 in direction 808 (counter-clockwise as oriented in FIGS. 8A-8C). The rotation of pivot link 250 causes damper 136 to slide longitudinally in direction 816 until damper pin 132 abuts the closed end of slot 238. With cylinder 242 prevented from further longitudinal movement in direction 816, damping begins as pivot link 250 pulls piston rod 240 in direction 816 outwardly from cylinder 242. Piston head 241 moves through cylinder 242 providing the damping functionality. Cylinder 242 is free to pivot about damper pin 132 during the opening and closing of hinge 100.

Figure 7:
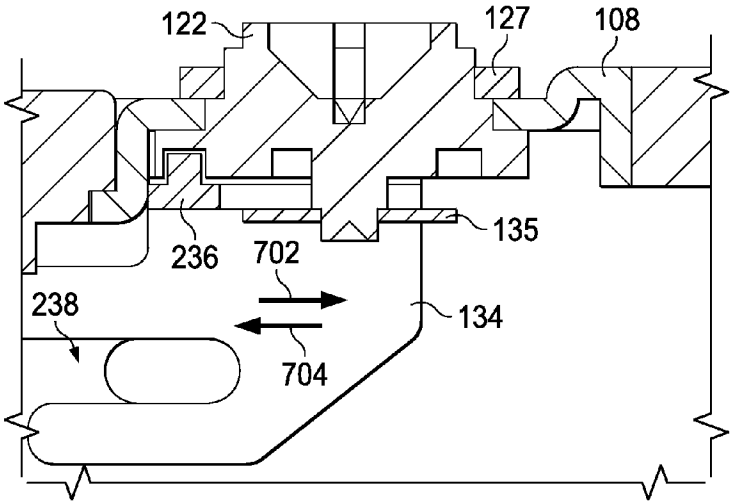
FIG. 7 is a partial sectional view of the helical cam and stop bracket of a preferred embodiment taken along line A-A of FIG. 1.

Ultimately, the position of stop bracket 134 with respect to hinge body 108 and damper pin 132 determines when the damping function of damper 136 begins. Therefore to adjust the damping functionality the longitudinal position of stop bracket 134 relative to hinge body 108 is adjusted. Adjusting the position of stop bracket 134 is accomplished by rotating helical cam 122. Damper pin 132 may slide within slot 232 with respect to hinge body 108. Rotating helical cam 122 alters the longitudinal position of stop bracket 134 with respect to hinge body 108. As helical cam 122 is rotated, protrusion 236 engages and follows groove 180 and causes stop bracket 134 to move longitudinally relative to hinge body 108. Protrusion 236 can follow the entire length of groove 180. A shown in FIG. 7, rotating helical cam 122 in a first direction results in stop bracket 134 moving longitudinally in direction 702. Rotating helical cam 122 in a second direction results in stop bracket 134 moving longitudinally in direction 704. Once the desired position is achieved, rotation of helical cam 122 is ceased. Positioning stop bracket 134 further from hinge cup 102 results in the damping functionality occurring sooner in the closing movement. Positioning stop bracket 134 closer to hinge cup 102 results in the damping functionality occurring later in the closing movement. Damping does not begin until damper pin 132 abuts the closed end of slot 238 in stop bracket 134. As a result, the further stop bracket 134 and slot 238 are from hinge cup 102, the sooner damper pin 132 abuts the closed end of slot 238 and the damping functionality begins during a closing movement.

In the open position, shown in FIG. 8A, spring arm 290 rests adjacent hinge body 108. Spring brace 292 contacts peak 284. In the open position, the distance between spring arm 290 and spring brace 292 is shown by distance 804. In the half open position (the cabinet door at an approximate 45° angle from the cabinet carcass), shown in FIG. 8B, the distance between spring arm 290 and spring brace 292 is shown by distance 805. In the closed position, shown in FIG. 8C, the distance between spring arm 290 and spring brace 292 is shown by distance 806. Distance 806 is greater than distance 805 and distance 805 is greater than distance 804. The bias of the spring weakens as the distance between spring arm 290 and spring brace 292 lengthens. During the closing movement, the damping force of damper 136 assists to overcome any variance in the bias of the spring. The bias of spring 116 opposes the damping force to close the door quietly and slowly.

Hinge 100 provides adjustment in two directions after mounting. One direction of adjustment is the depth movement of the cabinet door. This adjustment is required when the inside face of the door does not lay flush with the cabinet frame thus impeding the opening and closing action. To effect the depth adjustment, depth adjustment cam 124 is rotated. As depth adjustment cam is rotated, offset extension 125 engaged with depth adjustment hole 264 causes hinge body 108 to move longitudinally relative to inner frame 126. Once the desired position is achieved, rotation of depth adjustment cam 124 is ceased.

Another direction of adjustment is the overlay adjustment of the cabinet door. This adjustment is required when the vertical edges of the cabinet door do not align with the vertical edges of the cabinet frame or the vertical edges of an adjacent cabinet door. To effect the overlay adjustment, overlay adjustment screw 120 is rotated. Rotating overlay adjustment screw 120 such that overlay adjustment screw 120 advances in towards hinge body 108 moves hinge body 108 away from inner frame 126 creating distance between the hinge body 108 and inner frame 126. Rotating overlay adjustment screw 120 such that overlay adjustment screw 120 retreats out of threaded hole 320 moves hinge body 108 towards inner frame 126 removing distance between the two. As the distance between hinge body 108 and inner frame 126 increases or decreases, an overlay adjustment of the cabinet door with respect to the cabinet frame is achieved.

It should be noted that the installation orientation with the hinge cup fitted into a bore opening on a door and the hinge arm fitted on to the frame, could be reversed even though this is not the usual practice. In addition, the hinge of the present disclosure may be used in other applications that require a heavy duty hinge treatment, including furniture, security doors, safes, and the like.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. An adjustable soft close hinge comprising:

a hinge cup and a hinge body;

a hinge arm connecting the hinge cup and the hinge body;

a hinge link connecting the hinge cup and the hinge body;

wherein the hinge cup, hinge body, hinge arm and hinge link form a 4-bar linkage arrangement biased by a spring;

an inner frame adjustably connected to the hinge body;

a linkage sub-assembly connecting the hinge link to a damper, the damper having a damping function;

a stop bracket adjustably connected to the hinge body and receiving one end of the damper;

a helical cam seated in the hinge body and engaged with the stop bracket;

a groove in the helical cam;

a protrusion extending from the stop bracket and engaging the groove; and, wherein upon rotation of the helical cam, the protrusion moves through the length of the groove to adjust a longitudinal position of the stop bracket relative to the hinge body such that a start point of the damping function is adjusted.

2. The adjustable soft close hinge of claim 1 further comprising:

a peak on the hinge link;

a spring arm, extending from the spring, adjacent the hinge body;

a spring brace, extending from the spring, contacting the peak; and, wherein during a closing movement of the hinge, the spring brace maintains contact with the peak.

3. The adjustable soft close hinge of claim 1 wherein the hinge link is comprised of a plurality of interlocking plates.

4. The adjustable soft close hinge of claim 1 wherein the linkage sub-assembly further comprises:

a pivot link and a connecting link;

the pivot link connecting the damper and the connecting link; and, the connecting link connecting the pivot link and the hinge link.

5. The adjustable soft close hinge of claim 4 wherein the connecting link further comprises a pair of links bridged by a brace.

6. The adjustable soft close hinge of claim 4 wherein the pivot link is pivotally connected to the damper, the connecting link, and the hinge body.

7. The adjustable soft close hinge of claim 1 further comprising:

a first spacer adjacent the hinge link and the hinge body and a second spacer adjacent the hinge link and the hinge body.

8. The adjustable soft close hinge of claim 1 further comprising:

an overlay adjustment screw threadably attached to the hinge body and slidably attached to the inner frame; and, wherein upon rotation of the overlay adjustment screw, a relative distance between the hinge body and the inner frame is altered.

9. The adjustable soft close hinge of claim 1 further comprising:

a depth adjustment cam seated in and rotatable within the hinge body and rotatably connected to the inner frame; and, wherein upon rotation of the depth adjustment cam, a longitudinal position of the hinge body relative to the inner frame is altered.

10. The adjustable soft close hinge of claim 1 wherein the helical cam further comprises:

a lip section adjacent the hinge body;

a base section adjacent the lip section and seated within the hinge body;

a neck section adjacent the base section and extending from the hinge body;

a head section adjacent the neck section;

a lock ring, adjacent the neck section, connecting the helical cam to the hinge body;

a post extending from the lip section and slidably engaging the stop bracket; and, wherein upon rotation of the helical cam, the stop bracket moves longitudinally relative to the hinge body.

11. The adjustable soft close hinge of claim 1 further comprising:

the damper pivotally connected to the hinge body by a pin;

a slot on the stop bracket, having an open end and a closed end, where the pin is slidably engaged with the slot; and, wherein the damping function begins when the pin abuts the closed end.

12. The adjustable soft close hinge of claim 11 wherein a longitudinal position of the closed end is altered by rotation of the helical cam.

13. A low profile hinge comprising:

a hinge body having a generally U-shaped cross section comprised of an upper surface and a first side and a second side, where a damper pin is attached to the first side and the second side;

an inner frame, adjustably connected to the hinge body by an overlay adjustment screw threadably engaged with the upper surface and a depth adjustment cam rotatable within the upper surface, where the damper pin passes through the inner frame;

the hinge body pivotally connected to a hinge cup by a hinge arm and biased by a spring;

the hinge body pivotally connected to the hinge cup by a hinge link, where the hinge link is comprised of a plurality of interlocking plates;

a stop bracket adjustably connected to the hinge body by a helical cam rotatable within the upper surface;

a groove in the helical cam;

a protrusion extending from the stop bracket and engaging the groove; and a damper having a damping function, the damper slidable within the stop bracket and pivotally connected to the hinge link; and, wherein as the hinge moves from an open position to a closed position, the damper pin abuts the stop bracket and wherein upon rotation of the helical cam, the protrusion moves through the length of the groove to adjust a longitudinal position of the stop bracket relative to the hinge body such that a start point of the damping function is adjusted.

14. The low profile hinge of claim 13 further comprising:

a peak on the hinge link;

a spring arm, extending from the spring, adjacent the hinge body;

a spring brace, extending from the spring, contacting the peak; and, wherein during a closing movement of the hinge, the spring brace maintains contact with the peak.

15. The low profile hinge of claim 13 further comprising:

a linkage sub assembly pivotally connected to the hinge link and the damper.

16. The low profile hinge of claim 13 further comprising:

an overlay adjustment screw threadably attached to the upper surface and slidably attached to the inner frame;

a depth adjustment cam seated in the upper surface and rotatably connected to the inner frame;

wherein upon rotation of the overlay adjustment screw, a relative distance between the hinge body and the inner frame is altered; and, wherein upon rotation of the depth adjustment cam, a longitudinal position of the hinge body relative to the inner frame is altered.

17. A method of adjusting a damping function of a soft close hinge comprising:

providing a hinge cup and a hinge body;

providing a hinge arm connecting the hinge cup and the hinge body;

providing a hinge link connecting the hinge cup and the hinge body;

wherein the hinge cup, hinge body, hinge arm and hinge link form a 4-bar linkage arrangement biased by a spring;

providing a damper connected to the hinge link, the damper having a damping function;

providing a stop bracket adjustably connected to the hinge body, the stop bracket receiving one end of the damper;

providing a helical cam seated in the hinge body and engaged with the stop bracket;

providing a groove in the helical cam;

providing a protrusion extending from the stop bracket and engaging the groove; and rotating the helical cam;

wherein upon rotation of the helical cam, the protrusion moves through the length of the groove to adjust a longitudinal position of the stop bracket relative to the hinge body such that a start point of the damping function is adjusted.

* * * * *